US009458808B1

(12) United States Patent
Torgerud

(10) Patent No.: US 9,458,808 B1
(45) Date of Patent: Oct. 4, 2016

(54) MARINE PROPULSION DEVICES AND FUEL INJECTION SYSTEMS FOR MARINE PROPULSION DEVICES

(71) Applicant: Brunswick Corporation, Lake Forest, IL (US)

(72) Inventor: Michael A. Torgerud, Mt. Calvary, WI (US)

(73) Assignee: Brunswick Corporation, Lake Forest, IL (US)

( * ) Notice: Subject to any disclaimer, the term of this patent is extended or adjusted under 35 U.S.C. 154(b) by 102 days.

(21) Appl. No.: 14/570,400

(22) Filed: Dec. 15, 2014

(51) Int. Cl.
*F02M 69/46* (2006.01)
*F02M 63/02* (2006.01)
*F02M 19/06* (2006.01)

(52) U.S. Cl.
CPC ..... *F02M 63/0275* (2013.01); *F02M 19/066* (2013.01)

(58) Field of Classification Search
CPC ..... F02M 19/066; F02M 63/0275; F02M 69/465; F02M 55/025
USPC ..... 123/456, 468
See application file for complete search history.

(56) References Cited

U.S. PATENT DOCUMENTS 5,080,069 A * 1/1992 Hudson, Jr. ..... F02M 69/465 123/456
5,408,971 A 4/1995 Jaeger et al.
5,595,160 A * 1/1997 Matsumoto ..... F02M 69/465 123/456
5,641,126 A * 6/1997 Nally ..... F02M 61/145 239/575
5,771,863 A * 6/1998 Daly ..... F02M 35/10072 123/184.61
5,803,051 A * 9/1998 Stehr ..... F02M 55/025 123/456
6,161,527 A 12/2000 Ruman
6,199,775 B1 * 3/2001 Dallmeyer ..... F02M 37/22 123/470
6,405,712 B1 * 6/2002 Nomura ..... F02M 55/025 123/41.31
6,527,603 B1 3/2003 Wickman et al.
6,718,953 B1 4/2004 Torgerud
6,761,150 B2 * 7/2004 Zdroik ..... F02M 69/465 123/456
7,395,814 B1 7/2008 Doepke et al.
7,617,991 B2 * 11/2009 Wells ..... F02M 61/165 137/544
7,832,380 B1 11/2010 Abou Zeid et al.

* cited by examiner

*Primary Examiner* — Hai Huynh
(74) *Attorney, Agent, or Firm* — Andrus Intellectual Property Law, LLP

(57) ABSTRACT

A marine propulsion device comprises an internal combustion engine that has a piston-cylinder. A fuel injector injects fuel into the internal combustion engine. A fuel rail conveys the fuel to the fuel injector. The fuel rail has an upstream inlet end that receives the fuel and a downstream outlet end that supplies the fuel to the fuel injector. A fuel hose has an upstream inlet end that receives the fuel from a fuel reservoir and a downstream outlet end that discharges the fuel to the inlet end of the fuel rail. A filter element axially extends into at least one of the fuel rail and the fuel hose. The filter element is configured to filter particulate materials from the fuel.

20 Claims, 5 Drawing Sheets

MARINE PROPULSION DEVICES AND FUEL INJECTION SYSTEMS FOR MARINE PROPULSION DEVICES

FIELD

The present disclosure relates to marine propulsion devices and more particularly to fuel injection systems for marine propulsion devices.

BACKGROUND

The following U.S. patents are incorporated herein by reference in entirety:

U.S. Pat. No. 7,832,380 discloses a marine engine fuel system that provides a low pressure lift pump to draw fuel from a fuel tank and cause the fuel to flow into a reservoir and a high pressure fuel pump which draws fuel from the reservoir and provides it to a fuel rail. An inlet conduit of the high pressure fuel pump is provided with a primary and a secondary opening. The secondary opening can be an orifice formed through a wall of the inlet conduit. The secondary opening is positioned, relative to the primary opening, at a location which assists in controlling the fuel level within the reservoir and the quantity of gaseous fuel contained within an ullage above the liquid pool of fuel.

U.S. Pat. No. 7,395,814 discloses a fuel system for a marine propulsion device that controls the pressure of liquid fuel within a fuel rail by altering the pump speed of a fuel pump. The fuel pressure in the rail is measured by a pressure transducer which provides an output signal to a microprocessor that allows the microprocessor to select an operating speed for the fuel pump that conforms to a desired fuel pressure in the rail. By decreasing or increasing the operating speed of the positive displacement fuel pump as a function of the measured pressure in the rail, the microprocessor can accurately regulate the fuel pressure.

U.S. Pat. No. 6,718,953 discloses a fuel delivery system for a marine engine, which provides first, second, and third reservoirs of a fuel vapor separator and first, second, and third pumps to cause fuel to be drawn from the fuel tank and provided to the combustion chambers of an internal combustion chamber. A flow directing component is provided to inhibit recirculated fuel from mixing directly with fuel within the fuel vapor separator that has not yet been pumped to a fuel rail. The flow directing component receives recirculated fuel and also receives fuel from a second reservoir through an orifice formed through a surface of the flow directing component.

U.S. Pat. No. 6,527,603 discloses a fuel system for a marine propulsion system that includes a reservoir that defines a cavity in which first and second fuel pumps are disposed. The first fuel pump is a lift pump which draws fuel from a fuel tank and pumps the fuel into the cavity of the reservoir. The second fuel pump is a high pressure pump which draws fuel from the cavity and pumps the fuel at a higher pressure to a fuel rail of an engine.

U.S. Pat. No. 6,161,527 discloses a fuel injection system that incorporates a plurality of fuel injection arrangements, wherein each fuel injection is associated with a particular cylinder of the engine. Each of the fuel injection arrangements comprises a fluid passageway in which fuel and air are combined prior to injection into a combustion chamber of the cylinder. A valve is moveable with respect to an injection port to allow the pressurized fuel/air mixture to flow from the fluid passageway into the combustion chamber. A fuel injector is used to inject liquid fuel into the fluid passageway to be combined with pressurized air within the passageway. The system has a common air rail and a common fuel rail which are each connected to a plurality of the fuel injection arrangements. Upward movement of a piston within a cylinder is used to pressurize the air within the common air rail. All of the fuel injection arrangements can be used to contribute pressurized air to the common air rail.

U.S. Pat. No. 5,408,971 discloses a fuel rail assembly for an internal combustion engine including an elongated rail having a longitudinal inlet passage and a longitudinal outlet passage. The upstream end of the inlet passage is connected to a fuel supply line while the downstream end of the inlet passage is connected through a pressure regulator to the upstream end of the outlet passage. A return fuel line is connected to the downstream end of the outlet passage. A plurality of injector bores communicate with the inlet passage and extend to the exterior of the rail and each injector bore receives one end of a fuel injector, while the opposite end of each injector is sealed within a bore in a runner of an intake manifold. The injectors are mounted in a manner to provide limited tilt to facilitate assembly with the bores in the fuel rail and the manifold reservoir.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a marine propulsion device comprises an internal combustion engine that has a piston-cylinder. A fuel injector injects fuel into the internal combustion engine. A fuel rail conveys the fuel to the fuel injector. The fuel rail has an upstream inlet end that receives the fuel and a downstream outlet end that supplies the fuel to the fuel injector. A fuel hose has an upstream inlet end that receives the fuel from a fuel reservoir and a downstream outlet end that discharges the fuel to the inlet end of the fuel rail. A filter element axially extends into at least one of the fuel rail and the fuel hose. The filter element is configured to filter particulate materials from the fuel.

In certain examples, a filter element comprises a body that is configured to axially extend into at least one of the fuel rail and the fuel hose. The body comprises an open first end, a closed second end, and a sidewall that axially extends between the open first end and the closed second end. The sidewall defines a passageway that receives fuel via the open first end and conveys the fuel towards the closed second end. The sidewall defines at least one window. A screen is in the at least one window. The fuel radially flows from the passageway through the screen and into the fuel rail. The body is radially inwardly tapered from the open first end to the closed second end.

BRIEF DESCRIPTION OF THE DRAWINGS

The present disclosure is described with reference to the following Figures. The same numbers are used throughout the Figures to reference like features and like components.

DETAILED DESCRIPTION OF THE DRAWINGS

Figure 1:
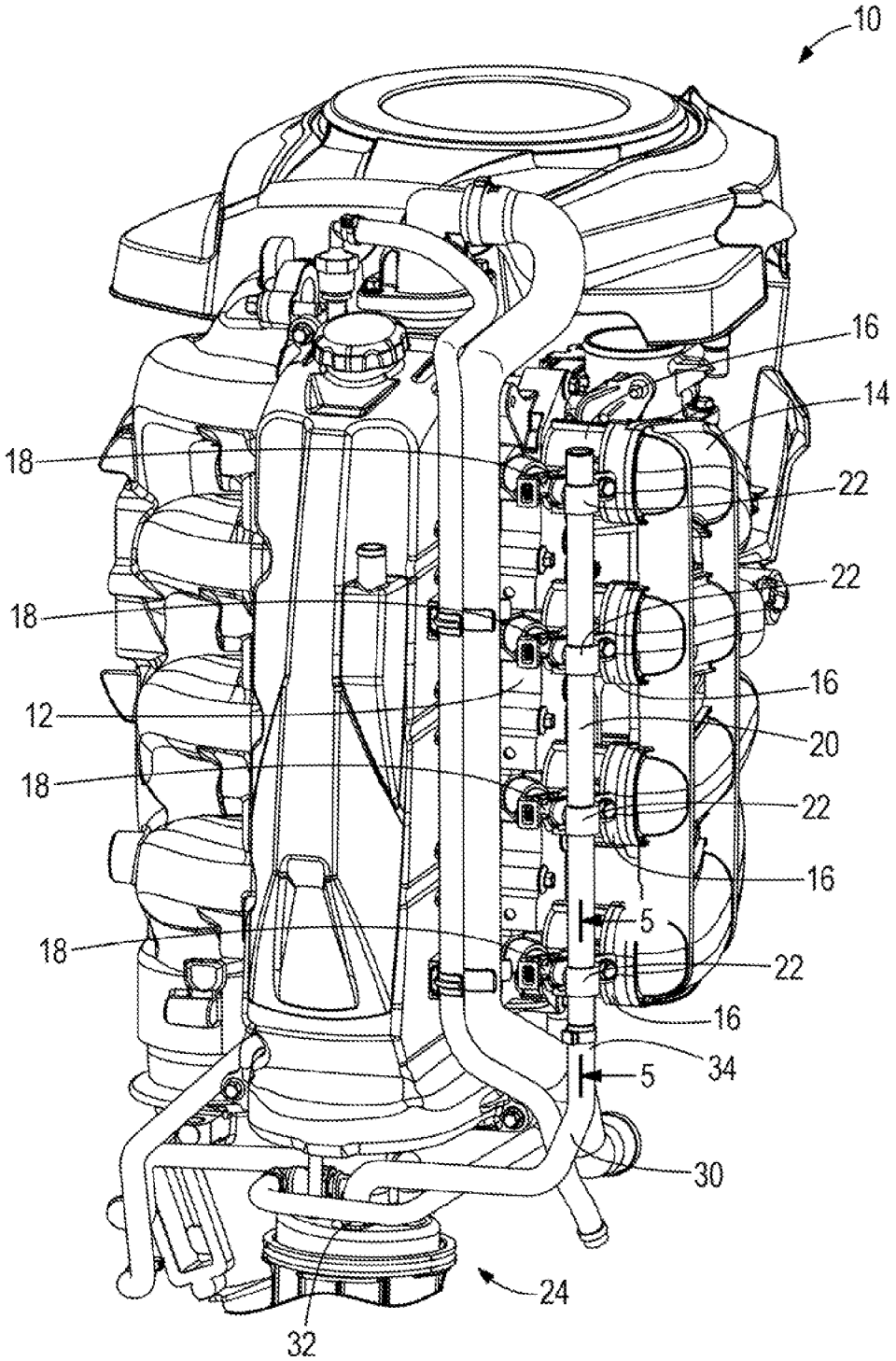
FIG. 1 is a perspective view of an internal combustion engine for a marine propulsion device.

FIG. 1 depicts an internal combustion engine 10 for a marine propulsion device, such as an outboard motor. The engine 10 has an engine block 12 and cylinder head 14, which together define a plurality of vertically-aligned piston-cylinders 16. The number of piston-cylinders can vary from that which is shown and in certain examples can include one piston-cylinder or more than one piston-cylinder. A corresponding plurality of fuel injectors 18 are connected to the engine block 12 and configured to inject fuel in the respective plurality of piston-cylinders 16, as is conventional. An elongated fuel rail 20 is attached to the fuel injectors 18 by attachment brackets 22. The fuel rail 20 conveys fuel from a fuel reservoir (fuel tank) 24 to the fuel injectors 18. The configuration of the fuel rail 20 can also vary from that which is shown in and in some examples can be a curvi-linearly elongated conduit, rather than a straight linearly elongated conduit.

Figure 2:
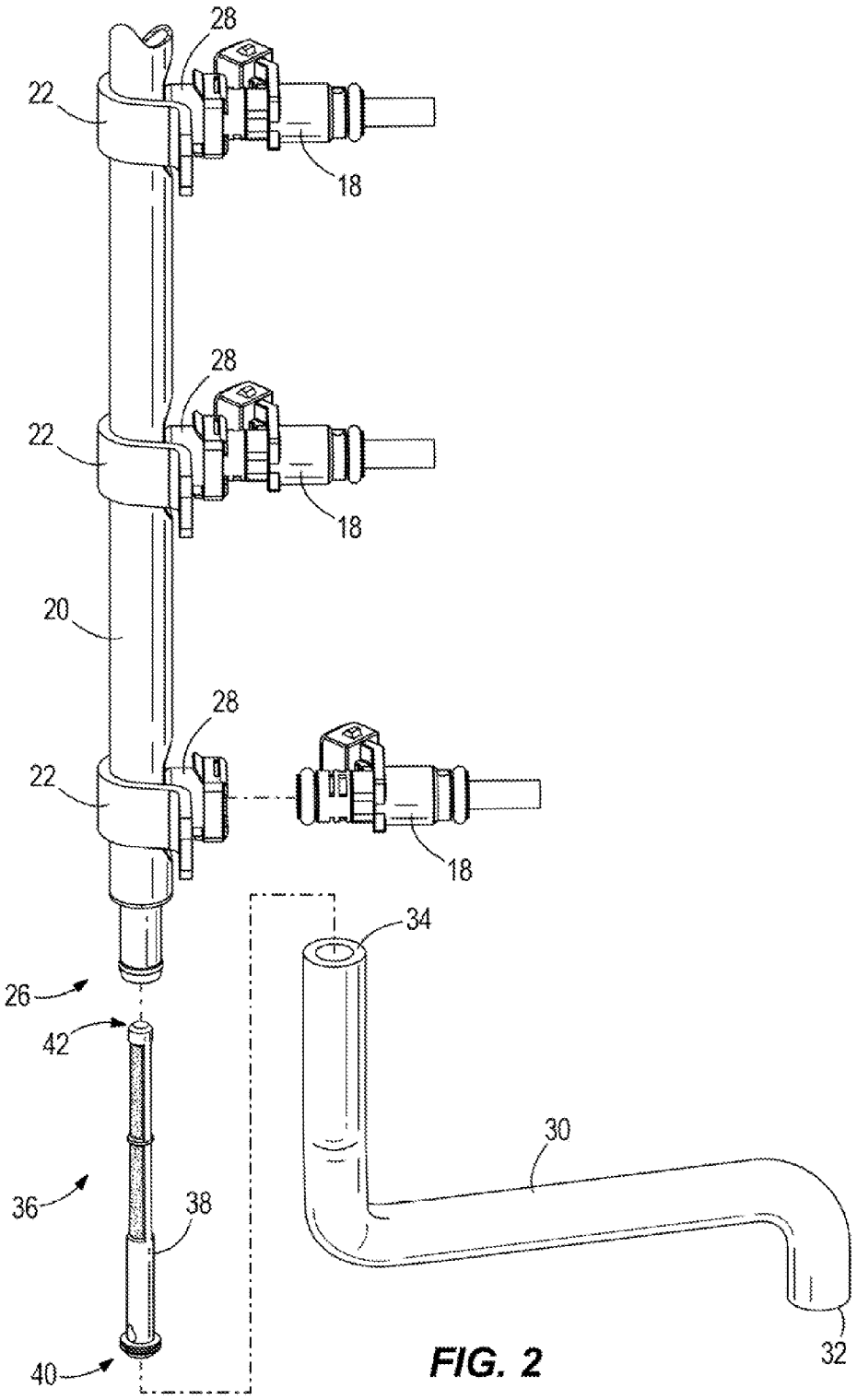
FIG. 2 is an exploded view of a fuel rail, a filter element disposed in the fuel rail, and a fuel hose that delivers fuel to the fuel rail via the filter element.
Figure 3:
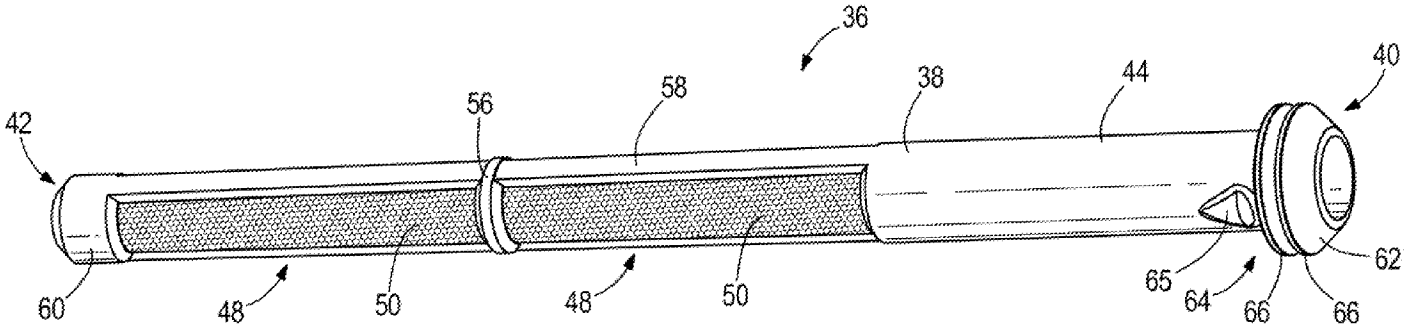
FIG. 3 is a perspective view of the filter element.
Figure 4:
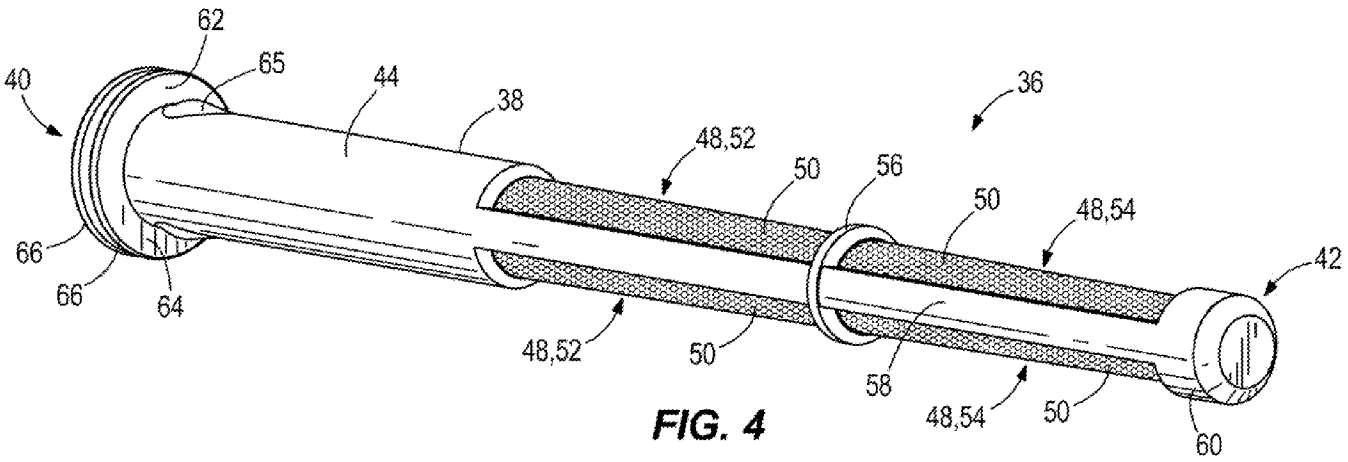
FIG. 4 is a perspective view of the filter element.
Figure 5:
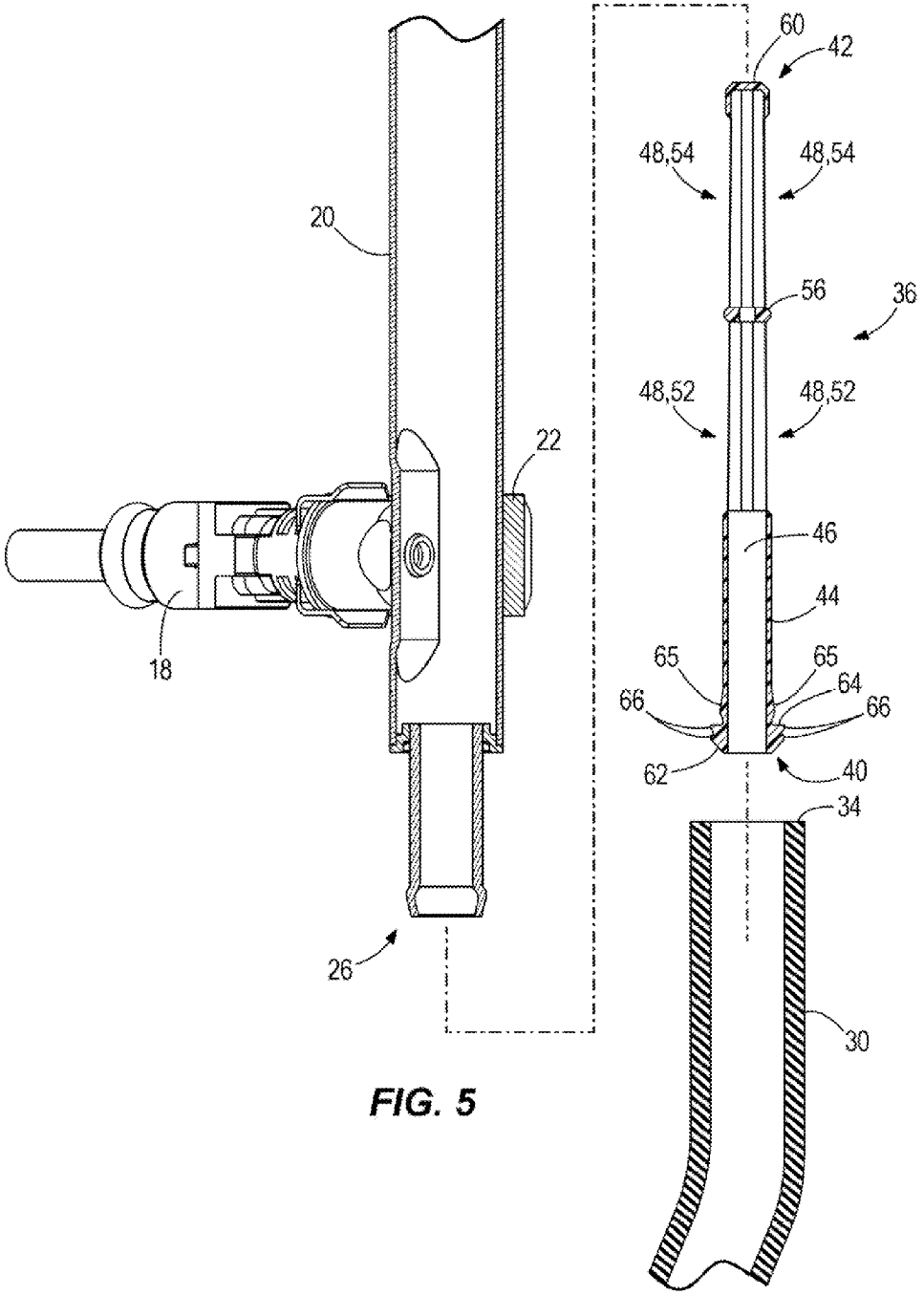
FIG. 5 is an exploded sectional view of Section 5-5 taken in FIG. 1.

Referring to FIG. 2, the fuel rail 20 has an upstream inlet end 26 that receives the fuel from the fuel reservoir 24 and a downstream plurality of outlets 28 that supply the fuel to the plurality of fuel injectors 18 for injection to the piston-cylinders 16. In this example, the plurality of outlets 28 of the fuel rail 20 extend transversely to the inlet end 32 of the fuel rail 20; however again the exact configuration of the fuel rail 20 can vary from that which is shown. A fuel hose 30 has an upstream inlet end 32 that receives the fuel from the fuel reservoir 24 and a downstream outlet end 34 that discharges the fuel to the inlet end 26 of the fuel rail 20.

Referring to FIGS. 2-8, a filter element 36 axially extends into the fuel rail 20 and is configured to filter particulate materials from the fuel. The filter element 36 includes an elongated body 38 that axially extends into the inlet end 26 of the fuel rail 20. In other examples, the elongated body 38 can instead extend into the fuel hose 30. The elongated body 38 has an open first end 40, a closed second end 42, and a side wall 44 that axially extends between the open first end 40 and the closed second end 42. The elongated body 38 is straight, i.e. linearly elongated; however in other examples the elongated body 38 can be curved, i.e. curvilinear. The side wall 44 defines an internal elongated passageway 46 that receives the fuel via the open first end 40 and conveys the fuel downstream towards the closed second end 42. In this example, the downstream outlet end 34 of the fuel hose 30 overlaps both the open first end 40 of the elongated body 38 and the upstream inlet end 32 of the fuel rail 20, thus eliminating any external leak path. Again however, this configuration can vary from that which is shown.

Figure 8:
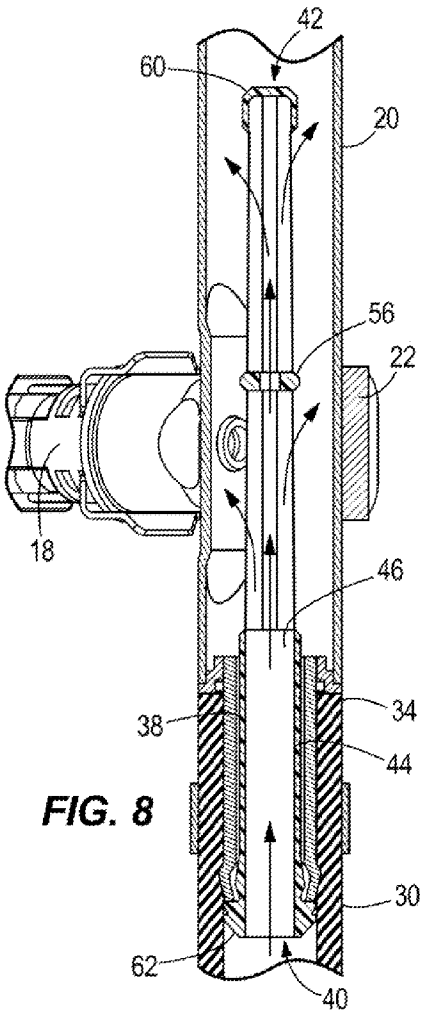
FIGS. 6-8 depict assembly of the filter element with respect to the fuel rail and the fuel hose.

The elongated body 38 is radially inwardly tapered from the open first end 40 to the closed second end 42. The side wall 44 defines a plurality of windows 48. A filter screen 50 is disposed in each window 48. As shown in FIG. 8, the fuel axially flows from upstream to downstream along the passageway 46 and then transversely from the passageway 46 through the filter screen 50 and into the fuel rail 20. The elongated body 38 has one or more windows through which the fuel flows. In this example, the elongated body 38 has a pair of upstream windows 52 and a pair of downstream windows 54. The upstream windows 52 are located on opposite sides of the elongated body 38 with respect to each other and the downstream windows 54 are located on opposite sides of the elongated body 38 with respect to each other. As shown in the Figures, the pair of downstream windows 54 are located between the closed second end 42 and the pair of upstream windows 52. The side wall 44 includes a brace 56 that peripherally extends around the elongated body 38 and is located axially between the upstream windows 52 and downstream windows 54. The side wall 44 also has a pair of axially extending braces 58 that extend between the respective upstream windows 52 and respective downstream windows 54. The braces 58 are on opposite sides of the elongated body 38 with respect to each other.

Figure 7:
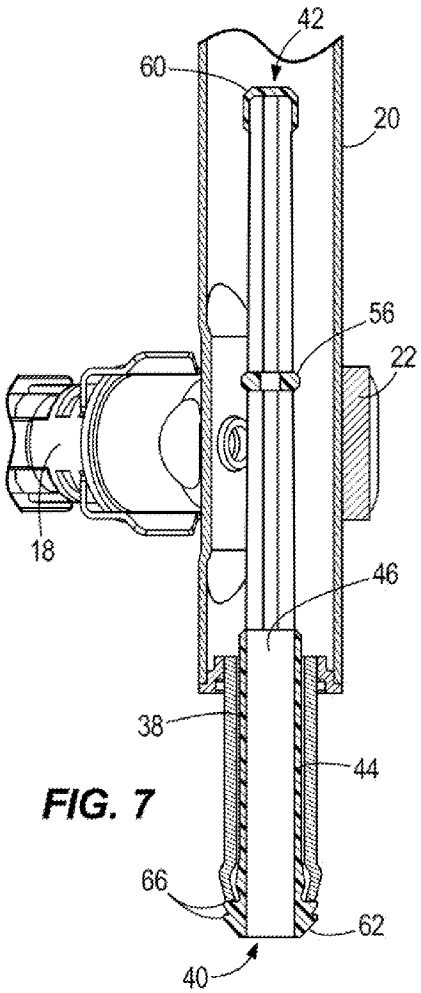
Figure 6:
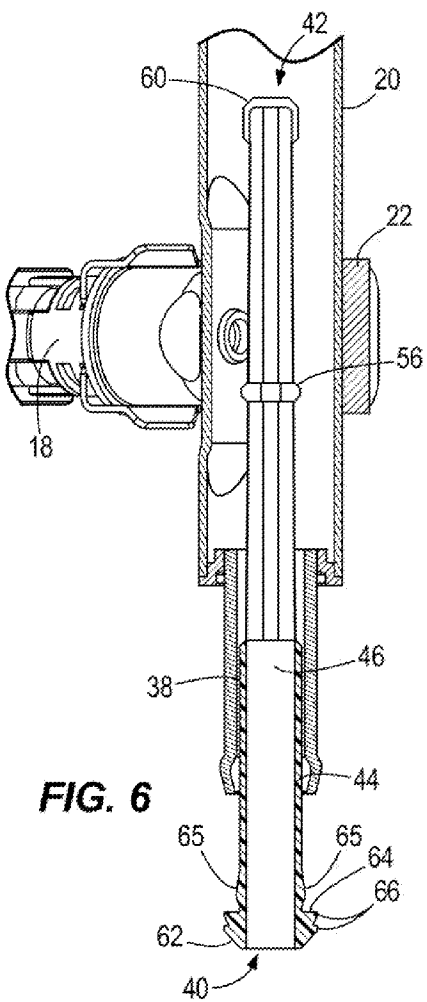

In this example, a cap 60 is disposed on the closed second end 42. An expansion 62 is disposed on the open first end 40. The expansion 62 defines a radially outer flange 64 that abuts the inlet end 26 of the fuel rail 20 when the filter element 36 is inserted into the fuel rail 20, as shown in FIG. 8. A pair of protrusions 65 are disposed on opposite sides of the side wall 44. The protrusions 65 are configured such that the inlet end 26 of the fuel rail 20 engages with the protrusions 65 to secure the elongated body 38 with respect to the fuel rail 20, as shown in FIG. 7. The expansion 62 also defines radially outer barbs 66 that engage with an inner surface 68 of the fuel hose 30 to secure and preferably seal the fuel hose 30 with respect to the filter element 36 and inlet end 26 of the fuel rail 20, as shown in FIG. 8. The barbs 66 can also serve as a gripping surface for an operator to manually grasp the elongated body 38.

As shown in the example of FIG. 8, when the filter element 36 is fully inserted into the fuel rail 20, the closed second end 42 of the elongated body 38 is located downstream of a first outlet 28 of the plurality of outlets 28 that supply the fuel to the fuel injectors 18. The pair of downstream windows 54 are also located downstream of the noted first outlet 28.

Advantageously, the tapered configuration of the filter element 36 provides a larger surface area and thus longer life and less pressure drop across the element. The tapered configuration facilitates manual insertion of the filter element 36 into one of the fuel rail 20 and fuel hose 30. Dissipation of electrostatic charge also occurs through mating contact with the fuel rail 20, which is made of conductive metal, thereby eliminating static charge accumulation and preventing formation of potentially damaging high voltage discharge through polymers. Sealing of the filter element 36 with respect to the fuel rail 20 and the fuel hose 30 is accomplished without additional components since the radially outer barbs mate with the internal diameter of the flexible fuel hose 30, which typically is made of rubber, and radially outer flange 64 seats against the inlet end 26 of the fuel rail 20. The filter element 36 can be made of a nylon material and the fuel rail 20 typically is made of stainless steel.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives and modifications are possible within the scope of the appended claims.

What is claimed is:

1. A marine propulsion device comprising:

an internal combustion engine that has a piston-cylinder;

a fuel injector that injects fuel into the internal combustion engine;

a fuel rail that conveys the fuel to the fuel injector, the fuel rail having an upstream inlet end that receives the fuel and a downstream outlet end that supplies the fuel to the fuel injector;

a fuel hose that has an upstream inlet end that receives the fuel from a fuel reservoir and a downstream outlet end that discharges the fuel to the upstream inlet end of the fuel rail; and a filter element that axially extends into at least one of the fuel rail and the fuel hose, wherein the filter element is configured to filter particulate materials from the fuel.

2. The device according to claim 1, wherein the filter element comprises an elongated body that axially extends into the at least one of the fuel rail and the fuel hose.

3. The device according to claim 2, wherein the elongated body comprises an open first end and a closed second end, and wherein the elongated body is radially inwardly tapered from the open first end to the closed second end.

4. The device according to claim 2, wherein the elongated body comprises an open first end and a closed second end, and wherein the fuel hose overlaps both the open first end of the elongated body and the upstream inlet end of the fuel rail.

5. The device according to claim 4, further comprising an expansion on the open first end, wherein the expansion defines a radially outer flange that abuts the upstream inlet end of the fuel rail.

6. The device according to claim 4, further comprising a radially outer barb at the open first end, wherein the radially outer barb engages an inner surface of the fuel hose to secure the fuel hose with respect to the filter element.

7. The device according to claim 2, wherein the elongated body comprises an open first end and a closed second end, and wherein the elongated body extends into the upstream inlet end of the fuel rail.

8. The device according to claim 7, wherein the closed second end of the elongated body is located downstream of the downstream outlet of the fuel rail.

9. The device according to claim 2, wherein the elongated body comprises an open first end, a closed second end, and a sidewall that axially extends between the open first end and the closed second end, wherein the sidewall defines a passageway that receives the fuel via the open first end and conveys the fuel towards the closed second end.

10. The device according to claim 9, further comprising at least one protrusion on the sidewall, wherein the elongated body extends into the upstream inlet end of the fuel rail, and wherein the upstream inlet end of the fuel rail is engaged with the at least one protrusion to secure the elongated body with respect to the fuel rail.

11. The device according to claim 9, wherein the sidewall defines at least one window, and further comprising a screen in the at least one window, and wherein the fuel transversely flows from the passageway through the screen.

12. The device according to claim 11, wherein the at least one window comprises at least one upstream window and at least one downstream window, wherein the at least one downstream window is located between the closed second end of the fuel rail and the at least one upstream window.

13. The device according to claim 12, wherein the at least one upstream window comprises a pair of upstream windows that are located on opposite sides of the elongated body and wherein the at least one downstream window comprises a pair of downstream windows that are located on opposite sides of the elongated body.

14. The device according to claim 13, wherein the sidewall comprises a brace that peripherally extends around the elongated body and axially between the pair of upstream windows and the pair of downstream windows.

15. The device according to claim 13, wherein the sidewall comprises a pair of braces that axially extend between the pair of upstream windows and between the pair of downstream windows and are on opposite sides of the elongated body.

16. The device according to claim 13, and wherein the elongated body extends into the upstream inlet end of the fuel rail such that the pair of downstream windows is located downstream of the downstream outlet of the fuel rail.

17. A filter element for a fuel rail on an internal combustion engine, wherein the fuel rail is configured to convey the fuel from a fuel hose to a fuel injector, and wherein the fuel rail has an upstream inlet end that receives the fuel from the fuel hose and a downstream outlet end that supplies the fuel to the fuel injector, the filter element comprising:

a body that is configured to axially extend into at least one of the fuel rail and the fuel hose;

wherein the body comprises an open first end, a closed second end, and a sidewall that axially extends between the open first end and the closed second end, wherein the sidewall defines a passageway that receives fuel via the open first end and conveys the fuel towards the closed second end;

wherein the sidewall defines at least one window, and further comprises a screen in the at least one window, wherein the fuel radially flows from the passageway through the screen and into the fuel rail; and wherein the body is radially inwardly tapered from the open first end to the closed second end.

18. The filter element according to claim 17, wherein the at least one window comprises at least one upstream window and at least one downstream window that is located closer to the closed second end than the upstream window, wherein the at least one upstream window comprises a pair of upstream windows located on opposite sides of the body, and wherein the at least one downstream window comprises a pair of downstream windows located on opposite sides of the body.

19. The filter element according to claim 18, wherein the sidewall comprises a brace that peripherally extends around the body between the pair of upstream windows and the pair of downstream windows, and wherein the sidewall comprises a pair of braces that axially extend along the pair of upstream windows and the pair of downstream windows and on opposite sides of the body.

20. The filter element according to claim 19, further comprising an expansion on the open first end, wherein the expansion defines a radially outer flange that abuts the inlet end of the fuel rail, and wherein the expansion further defines a radially outer barb that engages with an inner surface of the fuel hose to secure the fuel hose with respect to the filter element.

* * * * *